US006520123B2

(12) United States Patent
Parker et al.

(10) Patent No.: US 6,520,123 B2
(45) Date of Patent: Feb. 18, 2003

(54) EXPANSION CAGE

(76) Inventors: Philip A. Parker, Rte. 2 Box 2264, Naples, TX (US) 75568; Patricia E. Garvin, 322 W. County Line Rd., Royse City, TX (US) 75189

( * ) Notice: Subject to any disclaimer, the term of this patent is extended or adjusted under 35 U.S.C. 154(b) by 0 days.

(21) Appl. No.: 09/909,043

(22) Filed: Jul. 19, 2001

(65) Prior Publication Data

US 2002/0033146 A1 Mar. 21, 2002

Related U.S. Application Data

(60) Provisional application No. 60/221,052, filed on Jul. 27, 2000.

(51) Int. Cl.[7] ..... G21C 13/024; G21C 13/04

(52) U.S. Cl. ..... 122/510; 122/493; 376/461; 4/419

(58) Field of Search ..... 122/493, 494, 122/496, 510; 376/285, 307, 461, 462; 4/419; 248/311.2, 142; 211/70.1, 191

(56) References Cited

U.S. PATENT DOCUMENTS 4,128,070 A * 12/1978 Shadid et al. ..... 220/901
4,175,666 A * 11/1979 Smith ..... 248/150
4,586,687 A * 5/1986 Ziaylek, Jr. ..... 248/316.5
4,759,523 A * 7/1988 Yakulis, Jr. et al. ..... 248/311.2
4,940,025 A * 7/1990 Ott et al. ..... 122/510
5,278,880 A * 1/1994 Baker et al. ..... 376/285
5,299,768 A * 4/1994 Berry ..... 248/311.2

OTHER PUBLICATIONS

Hargis Engineers, Gas Water Heater detail, 1 page.

Turner Engineers, Electric Water Heater Above mop sink 1 page.

Estes, McClure & Assoc., Suspended Electric Water Heater 1 page.

* cited by examiner

*Primary Examiner*—Gregory Wilson
(74) *Attorney, Agent, or Firm*—Slater & Matsil, L.L.P.

(57) ABSTRACT

An open-webbed cage support device providing support that enabling a mechanical device such as a thermal expansion tank to be suspended or mounted adjacent to the thermal water heating device without the need to improvise a "made in the field" support structure.

9 Claims, 4 Drawing Sheets

EXPANSION CAGE

BACKGROUND—CROSS-REFERENCE TO RELATED APPLICATIONS

This application is entitled to the benefit of Provisional Patent Application Ser. No. 60/221,052, filed Jul. 27, 2000.

FIELD OF THE INVENTION

This Invention is in the field of mechanical device and apparatus supports.

BACKGROUND OF THE INVENTION

In the fields of plumbing, it is common to install thermal expansion tanks at domestic water heaters. The purpose of these installed tanks are primarily to aid in the prevention of damage to the hot water storage tank from thermal expansion caused by increased temperatures of the heated water.

These tanks are typically sized to permit the thermal expansion of the water to inflate a bladder within the tank, thus permitting the water to expand without placing undo strain on the water heating device.

Typical manufactured expansion tanks that are sized to meet the thermal expansion needs of smaller sized water heaters are not equipped with their own supporting means. The manufacturer of these tanks has assumed that the attached piping can support the tank itself.

However, more frequently, it has been determined within the plumbing industry that many plumbing codes require that these tanks be self-supporting. This means that the code no longer permits the tank to be supported from above or below the adjoining piping system.

Thus far, the solution has been for the installer of the tank to devise some means to support the tank. Typically these means consist of sheet metal strapping that is not overly strong. Such improvised installations often appear less than of a quality assembly.

Often, mechanical engineers will detail such a support means as previously described detailing accurate sizes of strapping and locations as to where these straps should be positioned. Unfortunately, this though improved improvised method to support these tanks still lacks as a quality appearing and practical application.

SUMMARY

The invention is a support device to provide support to a thermal expansion tank by cradling the tank within a open webbed cage that is affixed to a wall surface, thus preventing the weight of the tank from resting on the attached piping system.

OBJECTS AND ADVANTAGES

Accordingly, several objects and advantages of our invention are:

A: The open webbed structure permits the thermal expansion tank to rest evenly within without placing undo strain on any individual portion of the outer surface.

B. The mounting holes permit ease in affixing the invention to a flat wall surface.

C. The lower open ring of the cage permits pipe connection fittings to reset comfortably through the ring.

Advantages over prior methods of supporting these expansion tanks include:

A. Uniformity and quality in the completed installation of a hot water tank and adjoining piping system.

B. Simplicity of the securing of the mounting apparatus intended to secure the expansion tank.

C. Avoidance of the need to improvise a means to secure the expansion tank.

D. Avoidance of possible rejection of the installation due to non-compliance with local building codes.

The cage is made of welded steel rod and is painted to prevent rusting of the metal. However, a material such as stainless steel or aluminum can be used in the construction, thus preventing the need of a protective paint finish.

Likewise, the cage can be made of plastic. The cage can also possess a cushion to help support the tank. This cushion is typically made of rubber or neoprene. It is positioned around the upper ring of the cage. When the tank is inserted into the cage, the sides of the tank will rest against this cushion.

DESCRIPTION OF THE DRAWINGS

FIG. 3-*a* is a partial side view showing the placement of the Cage along a flat wall surface.

LIST OF REFERENCE NUMERALS

Figure 1:
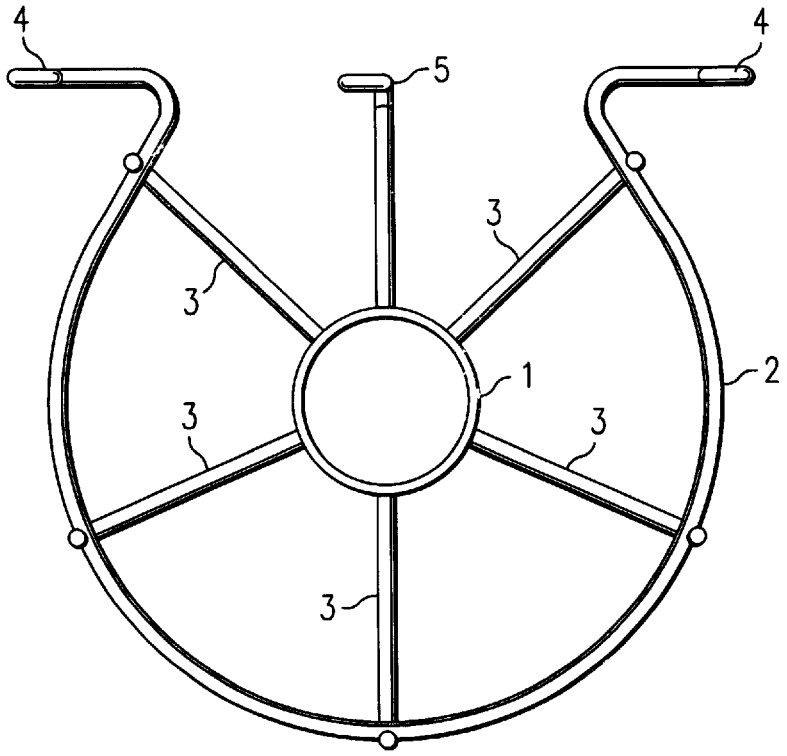
FIG. 1 is a top view of the Expansion Cage.

1. Lower ring
2. Upper ring
3. Support rods
4. Top eyelets
5. Lower eyelet
6. Screws
7. Expansion Tank
8. Threaded pipe fitting
9. Threaded Nut
10. Set-screw
11. Rubber gasket
12. Upper flat ring
13. Strap
14. Latching knob
15. Latch
16. Holes

DESCRIPTION OF THE INVENTION

The invented Expansion Cage is made of steel with all joints and seams welded to insure strength and durability. It is rounded and cylindrical in shape and of sufficient height to permit the comfortable positioning and support of a thermal expansion tank. The cage has a lower circular shaped ring that permits the bottom portion of the supported tank to fit flat to the bottom portion of the cage while permitting ease in making mechanical connections to the treaded fitting on the tank.

From this ring, a number of round supports wire rods extend first away from the ring in all directions. Then these rods extend vertically up from the base position thus creating a cylinder shaped open webbed cage. These rods are secured in place by the welding of each rod to a second circular shaped ring located at the top of the cage. This upper second ring, though circular, does not close to make a full circle around the cage. Rather, either end of this ring is bent in such a fashion to create a flattened plane at one vertical side of the cage. Rounded hooks or eyelets are also formed at the end of each side of this ring. An additional rod extends from the lower ring but rather than extending upward, it turns slightly down with an eyelet formed at its end.

This flattened plane will permit the cage to be easily affixed to a flat vertical surface such as a wall. The described eyelets permit the cage to become fastened to the wall or other surface by inserting attachment apparatuses such as screws or bolts.

DETAILED DESCRIPTION OF THE INVENTION

FIG. 1 is a top view of the cage. Lower ring 1 and upper ring 2 are visible. Support rods 3 extend outward from the lower ring. Top eyelets 4 as well as lower eyelet 5 are viewed from their side.

Figure 2:
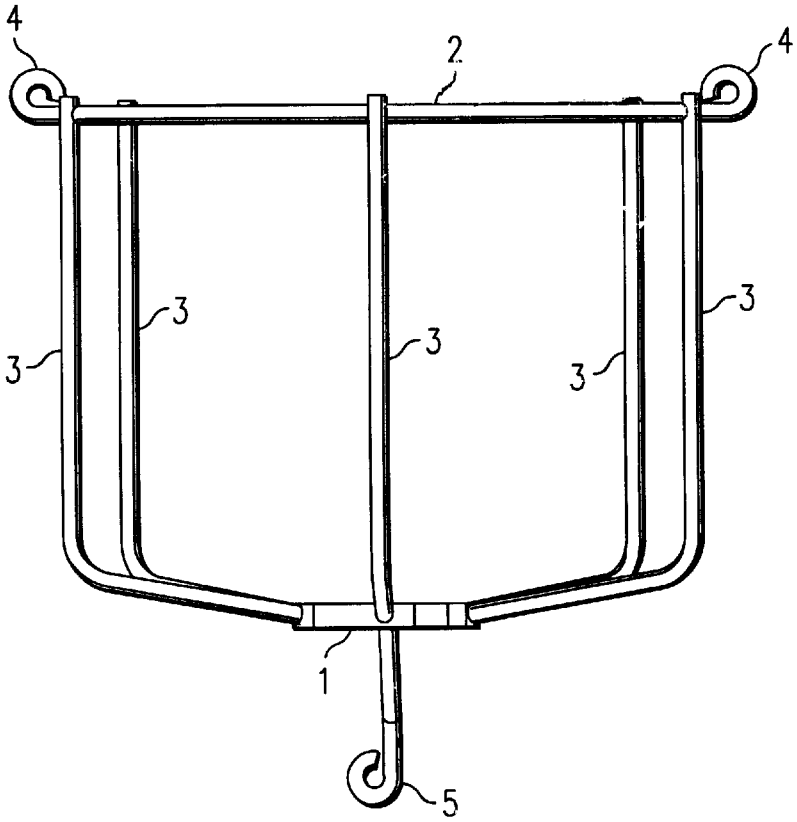
FIG. 2 is a side view of the Expansion Cage

Turning to FIG. 2, a frontal view of the cage. Both top eyelets 4 and the lower eyelet 5 are mode clearly shown. The closed eye is welded to insure strength.

Figure 3:
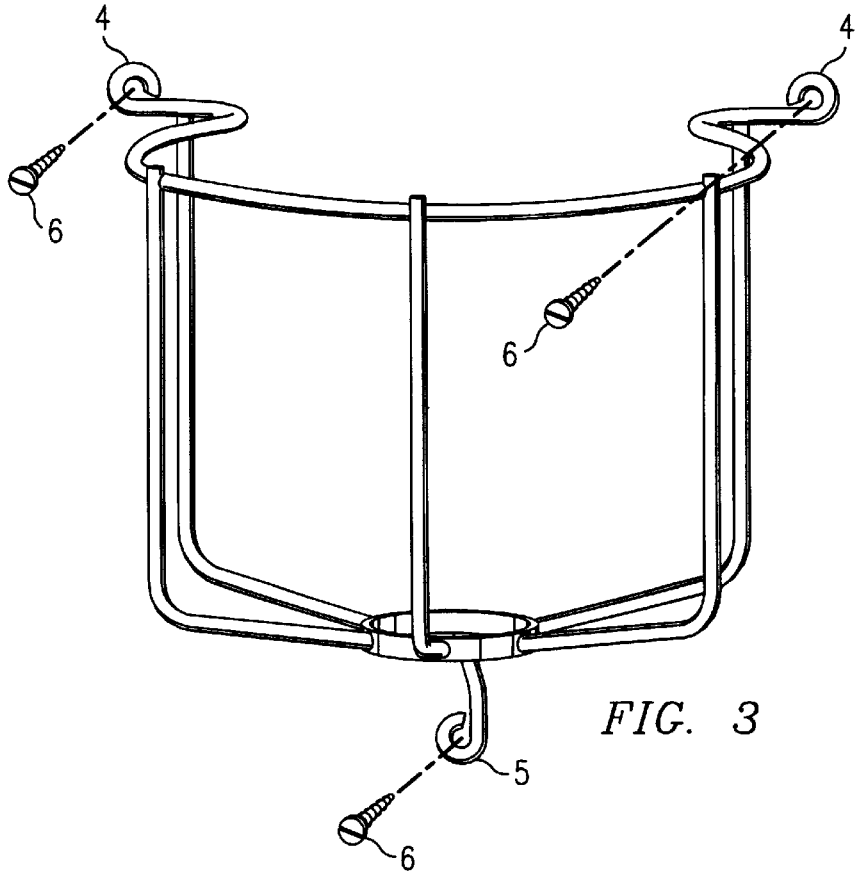
FIG. 3 is an isometric view of the cage.
Figure 3A:
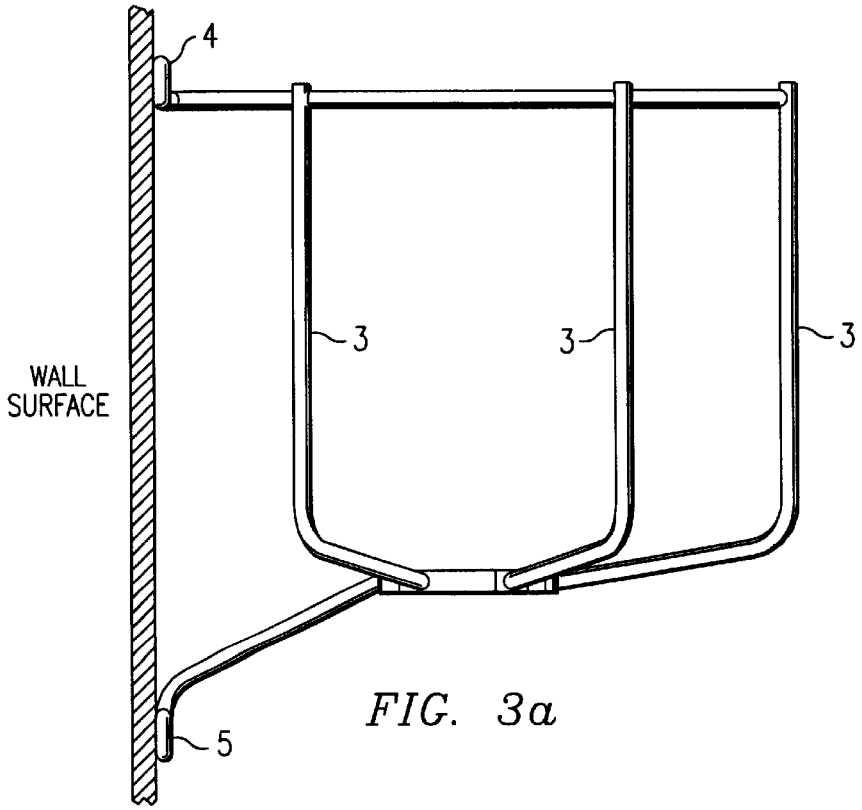

FIG. 3 is an isometric view of the cage. The flatten plane is demonstrated as having screws 6 affixing the cage to a wall surface. FIG. 3-*a* is a partial side view of this same demonstration showing clearly how the flattened plane fits against the flat wall surface.

Figure 4:
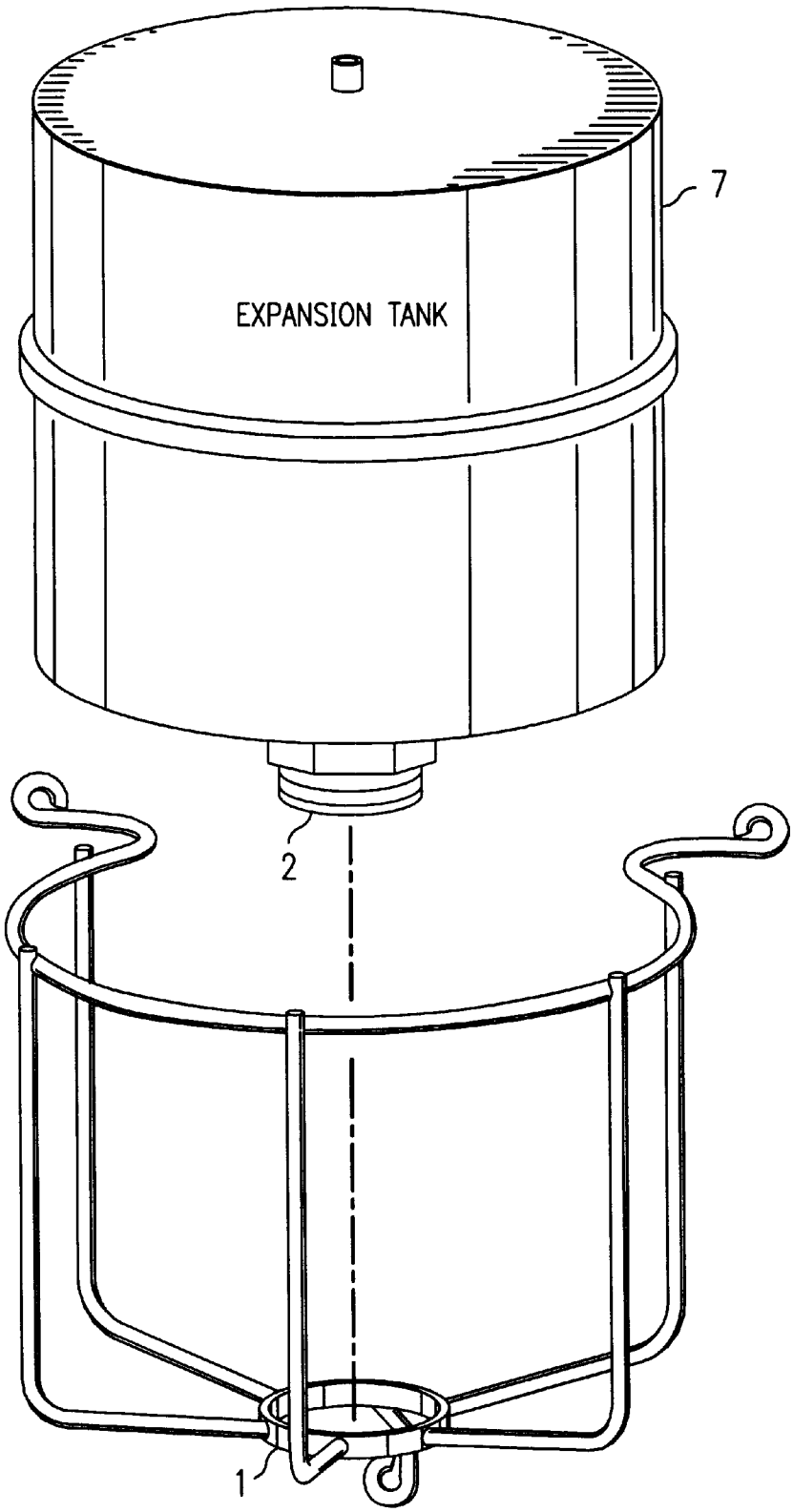
FIG. 4 is a view demonstrating the placement of an Expansion Tank within the Cage.

In FIG. 4, it is demonstrated how an Expansion Tank 7 if lowered into the cage. Threaded pipe fitting 8 of the tank fits through lower ring 1. Piping connections are made to this fitting after the tank is in position within the cage.

Other Embodiments of the Invention

The upper ring can also be made of flat steel that is formed into a circular shape. Utilizing this type of upper ring will permit threaded nuts to be positioned around the flat surface. By inserting screws or bolts similar to a conventional set-screw, the supported tank can be more rigidly secured and supported.

Figure 5:
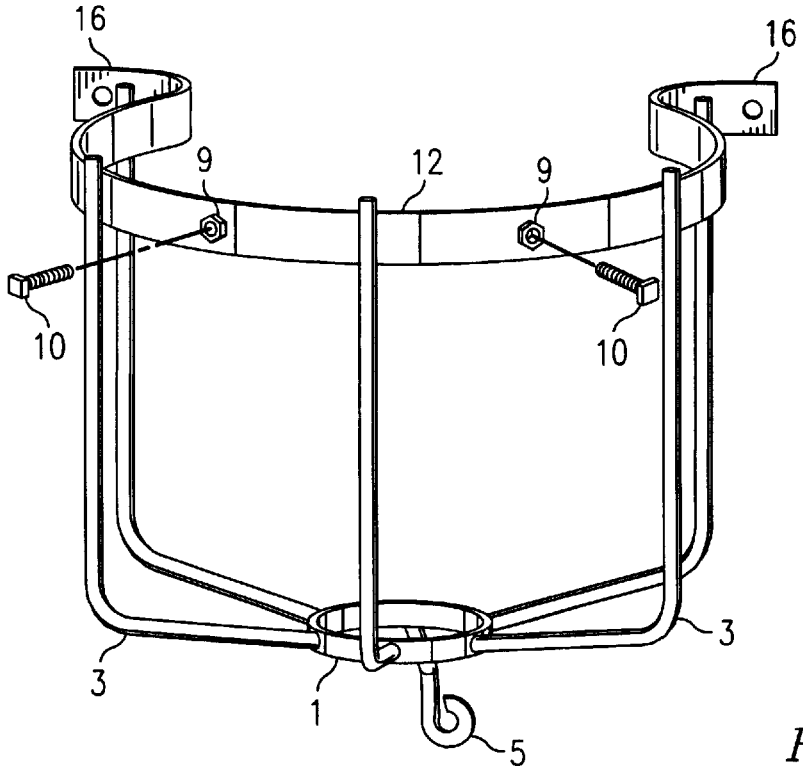
FIG. 5 is another embodiment of the Cage having a flat round upper ring.

FIG. 5 demonstrates how the upper ring of flat steel 12 has threaded nuts 9 affixed along its surface. Set-screws 10, when tightened against tank 7 secure the tank in place. The upper eyelets are replaced with holes 16 for the purpose of securing the cage to the wall surface.

Figure 6:
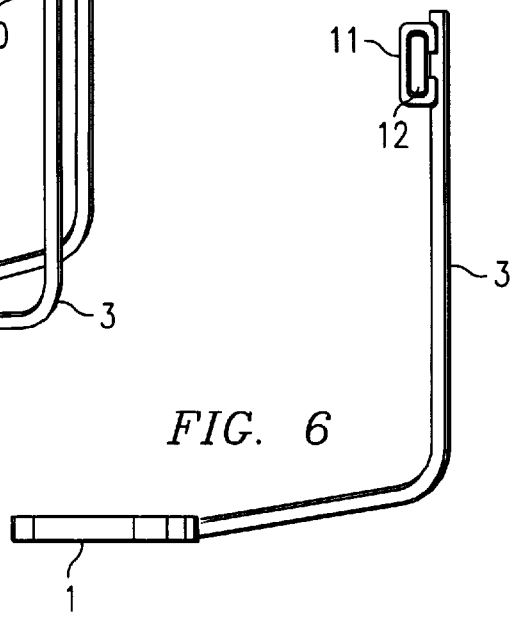
FIG. 6 is a partial side view of the upper ring with a rubber cushion in place.

FIG. 6 is a partial side view of the cage showing how a rubber gasket 11 is attached to upper ring 12.

Figure 7:
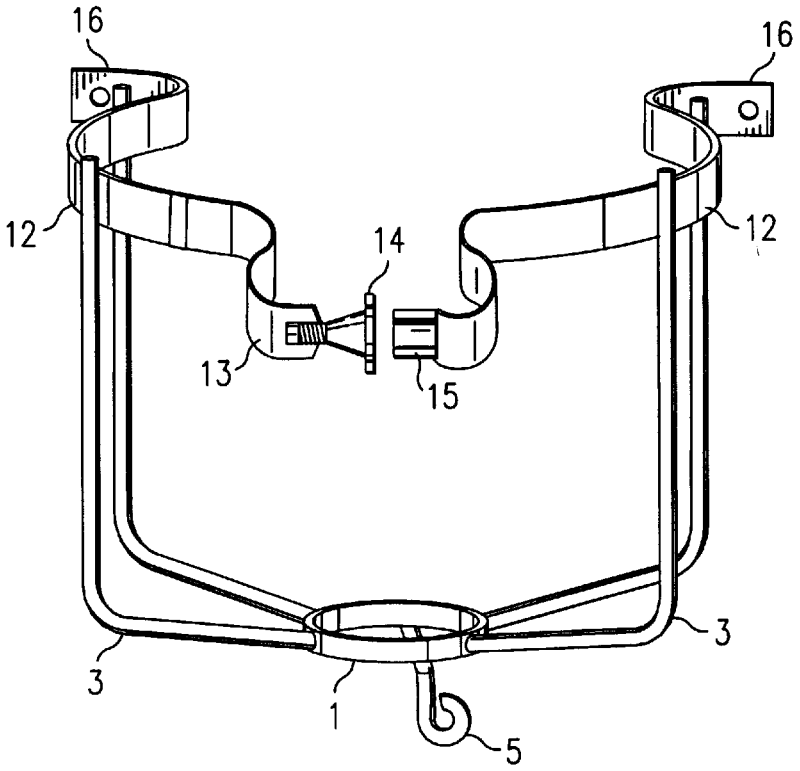
FIG. 7 is a view of an alternate embodiment of the Cage showing the technique of a buckle to secure the tank.

In addition, the outer position or plane of the cage can also be left open. That is the portion opposite to the flattened portion where the cage is mounted to a wall. In this alternate embodiment of the invention, A means of strapping the tank is employed to assist in the securing of the tank within the cage. This described strapping is of any number of conventional materials suited for this purpose. They include nylon, light-gauge sheet metal and rubber. A securing buckle is then utilized to tighten the strapping around the tank. FIG. 7 is an isometric view of this alternate embodiment of the invented cage. Here, upper ring 12 is divided into two pieces with strap 13 affixed to one side. Latching knob 14 inserts between the slots of latch 15 after the tank is positioned within the cage. This latch, latching knob, and strap makes up a bucket that holds the tank in place.

Conclusions, Ramifications, and Scope of the Invention

Thus the reader will see that the invented expansion cage provides a practical, inexpensive method to both secure and support a thermal expansion tank.

Although the description contains many specifications, these should not be construed as limiting the scope of the invention but as merely providing illustrations of the presently preferred embodiment of the invention. The many uses of the invention should not be limited by the example of use here in described. Thus the scope of the invention should be determined by the appended claims and their legal equivalents, rather than by the example given.

We claim:

1. A support cage for receiving a cylindrical-shaped expansion tank having a selected radius and a selected length comprising:

a lower support ring having an outside radius smaller than said selected radius of said cylindrical tank;

a plurality of radial members having a first end secured to said lower support ring, said radial member comprising a first portion extending radially outward from the circumference of said lower support ring for a distance greater than said radius of said cylindrical tank and a second portion extending perpendicular to said lower support ring for a distance less than said length of said cylindrical tank to a top end;

an upper support member secured to said top end of said plurality of radial member such that said lower support ring, said plurality of radial members, and said upper support member form said support cage; and a pair of attaching members, each one of said pair joined to said upper support member and each one defining an attaching portion lying in the same plane for rigidly attaching said support cage to a support member.

2. The support cage of claim 1 further comprising a bottom attaching member extending downward and radially from said lower support ring to said same plane for producing a bottom attachment to a support member.

3. The support cage of claim 1 wherein said support cage is formed from the group of materials consisting of plastic, stainless steel and aluminum.

4. The support cage of claim 1 wherein said lower support ring and said upper support member are secured to said radial member by welding.

5. The support cage of claim 1 wherein said upper support member and said pair of connecting members are formed as a single member.

6. The support cage of claim 1 further comprising a threaded member attached to said upper support member for receiving a set screw for tightening against said tank.

7. The support cage of claim 1 wherein said upper support member is a band.

8. The support cage of claim 7 wherein said band comprises a first flexible portion member suitable for coupling with a second flexible portion, said first and second flexible portion located opposite said attaching member to allow easy placement of said tank.

9. The support cage of claim 1 wherein said lower support ring allows access to a bottom connection on said expansion tank.

* * * * *